US005707255A

United States Patent [19]

Lu

[11] Patent Number: 5,707,255

[45] Date of Patent: Jan. 13, 1998

[54] ELECTRIC RECEPTACLE

[76] Inventor: Chong Ying Lu, P.O. Box 372, Hsin-Chu, Taiwan

[21] Appl. No.: 784,491

[22] Filed: Jan. 17, 1997

[51] Int. Cl.[6] ..... H01R 13/506

[52] U.S. Cl. ..... 439/686; 439/598

[58] Field of Search ..... 439/600, 601, 439/603, 621, 622, 686, 647–650, 597, 598, 599

[56] References Cited

U.S. PATENT DOCUMENTS 4,846,723 7/1989 Pong ..... 439/686

5,046,969 9/1991 Liao ..... 439/686

5,336,114 8/1994 Wang ..... 439/686

*Primary Examiner*—Hien Vu

[57] ABSTRACT

An electric receptacle including an insulative receptacle base mounted within an insulative housing to hold a hot wire and a neutral wire, wherein the insulative receptacle defines two longitudinal wire chambers diagonally disposed at two opposite sides of a horizontal base wall thereof for receiving the hot wire and the neutral wire respectively, and two longitudinal terminal chambers respectively separated from the longitudinal wire chambers at one side for receiving the terminals of the hot wire and neutral wire respectively.

1 Claim, 5 Drawing Sheets

ELECTRIC RECEPTACLE

BACKGROUND OF THE INVENTION

The present invention relates to electric receptacles, and more particularly to such an electric receptacle which isolates the terminals of the hot wire and neutral wire, and effectively protects against permeation of water by means of a series of isolating walls tenoned into a series of grooves to seal the seams therebetween.

A regular electric receptacle is generally comprised of an insulative receptacle base mounted within an insulative housing to hold a hot wire and a neutral wire. The insulative receptacle base comprises two longitudinal wire chambers disposed in parallel and separated by a partition wall for holding the hot wire and the neutral wire and their terminals. This structure of electric receptacle cannot effectively protect against permeation of rain water. When rain water passes to the inside, a short circuit may occur. In order to eliminate this problem, a water sealing work must be employed to the electric receptacle after its installation.

SUMMARY OF THE INVENTION

The present invention has been accomplished to provide an electric receptacle which eliminates the aforesaid problem. According to one aspect of the present invention to the hot wire and the neutral wire are diagonally mounted in the insulative receptacle base at two opposite sides, to prevent a short circuit between the terminals of the two electric wires. According to another aspect of the present invention, the insulative receptacle base has vertical outer walls and inner walls respectively fitted into respective longitudinal mounting grooves in the insulative housing to protect the terminals of the electric wires against rain water.

DETAILED DESCRIPTION OF THE PREFERRED EMBODIMENT

Figure 1:
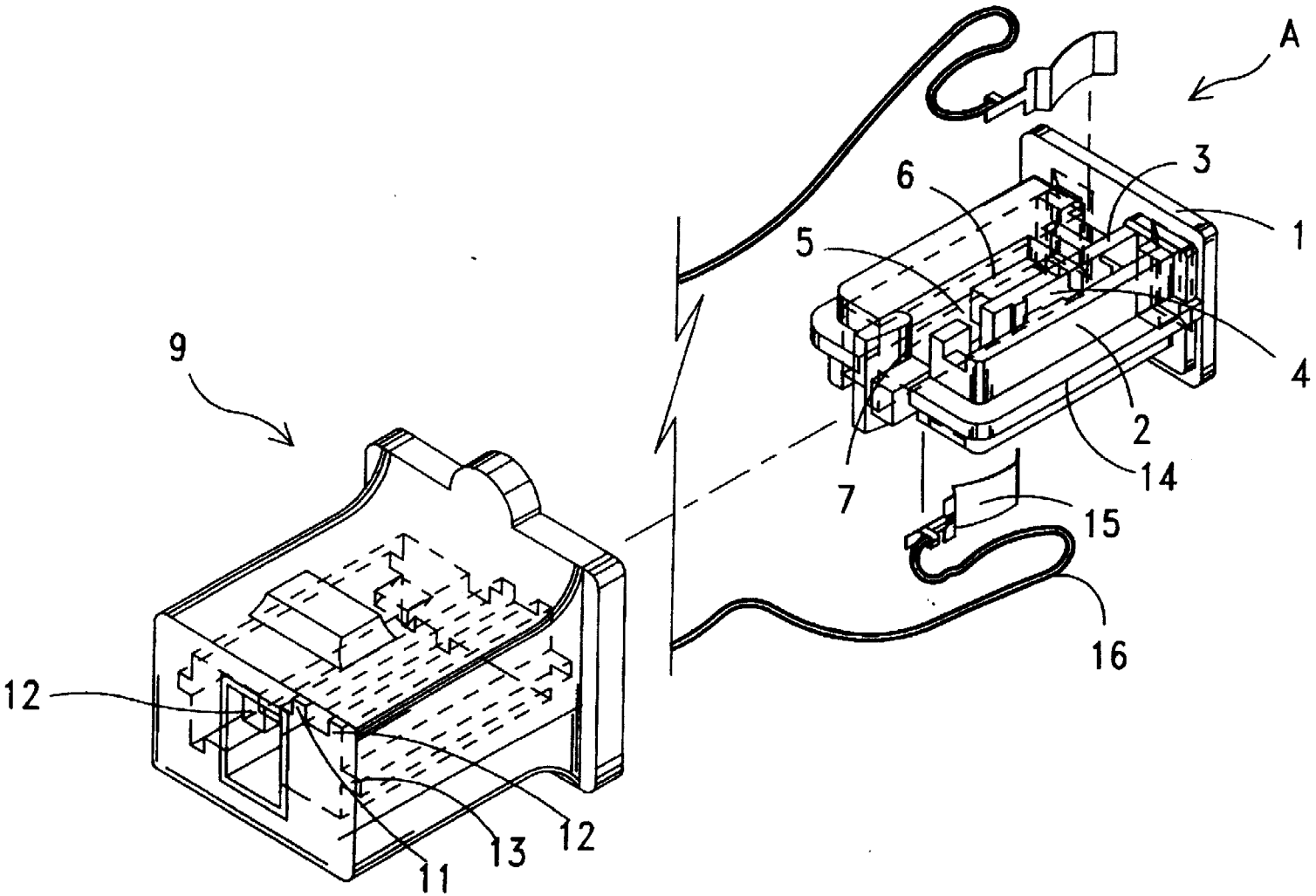
FIG. 1 is a perspective exploded view of an electric receptacle according to the present invention.
Figure 2A:
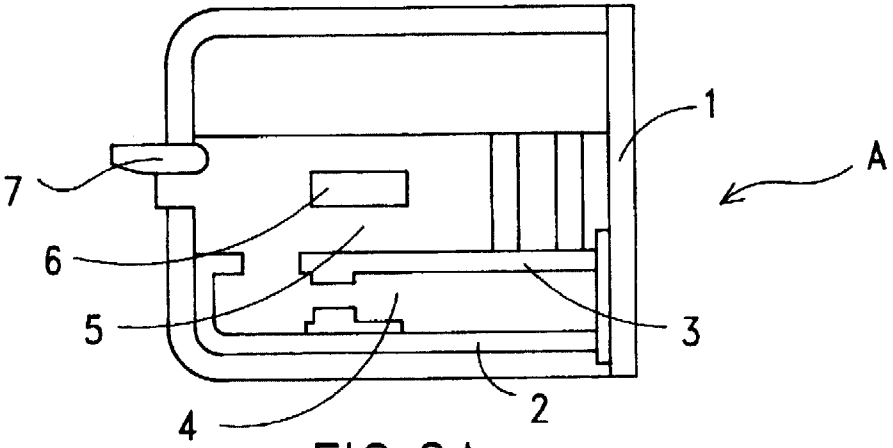
FIG. 2 is front, side, rear and top views of the insulative receptacle base of the electric receptacle shown in FIG. 1.
Figure 2:
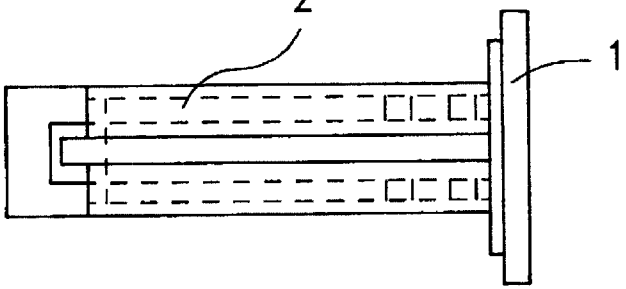
Figure 2C:
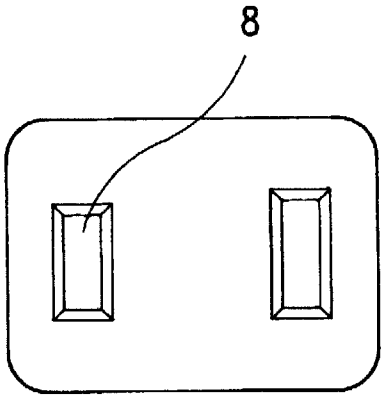
Figure 2B:
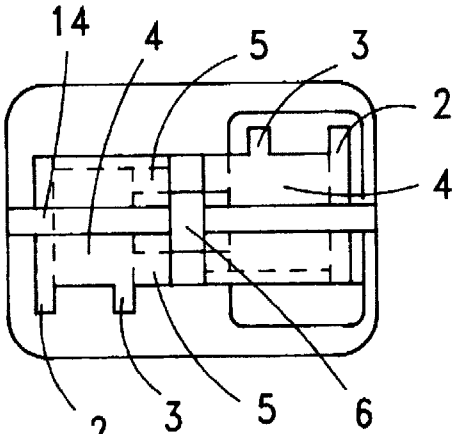
Figure 3A:
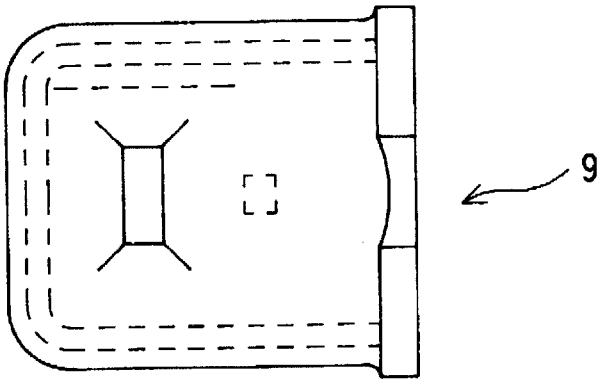
FIG. 3 is front, side, rear and top views of the insulative housing of the electric receptacle shown in FIG. 1.
Figure 3:
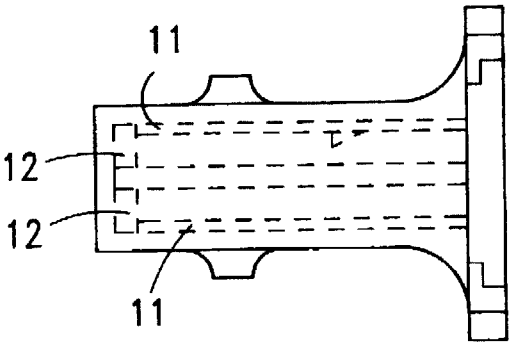
Figure 3C:
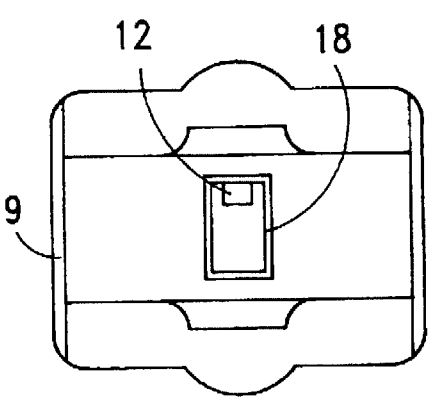
Figure 3B:
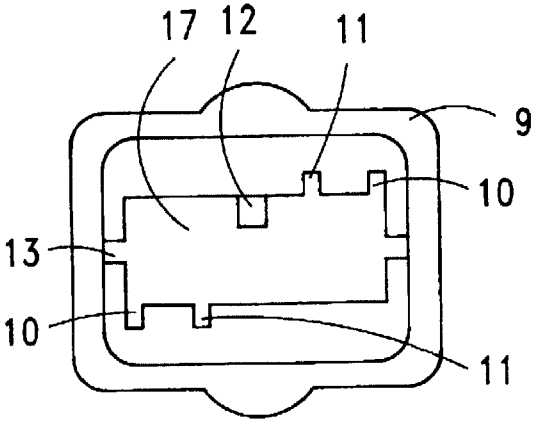

Referring to FIGS. from 1 to 4, an electric receptacle in accordance with the present invention is generally comprised of an insulative receptacle base A, an insulative housing 9, and two electric wires (the hot wire and the neutral wire) 16 having a respective terminal 15 at one end.

The insulative receptacle base A comprises a vertical face panel 1, two blade insertion slots 8 disposed in the vertical face panel 1 adapted for receiving the blades of an electric plug 19 (see also FIG. 5), a horizontal base wall 14 perpendicularly extended from the back side of the vertical face panel 1, two outer vertical walls 2 perpendicularly extended from the back side of the vertical face panel 1 and perpendicularly and diagonally raised from two opposite sides of the horizontal base wall 14, two inner vertical walls 3 perpendicularly extended from the back side of the vertical face panel 1 and perpendicularly and diagonally raised from two opposite sides of the horizontal base wall 14 and respectively disposed in parallel to the outer vertical walls 2 at an inner side, two elongated terminal chambers 4 respectively defined between the outer vertical walls 2 and the inner vertical walls 3 in alignment with the blade insertion slots 8, two longitudinal wire chambers 5 respectively defined at two opposite sides of the horizontal base wall 14 and disposed at one side of the inner vertical walls 3 opposite to the elongated terminal chambers 4, two springy blocks 6 perpendicularly raised from two opposite sides of the horizontal base wall 14 and respectively disposed in the longitudinal wire chambers 5, and two wire holes 7 respectively disposed diagonally in communication with the longitudinal wire chambers 5 at one end.

The insulative housing 9 comprises a mounting chamber 17 fitting the profile of the insulative receptacle base A, two symmetrical pairs of longitudinal mounting grooves 10, 11 diagonally disposed in the mounting chamber 17 at the top and bottom sides and adapted for receiving the outer vertical walls 2 and inner vertical walls 3 of the insulative receptacle base A, two horizontally spaced longitudinal sliding grooves 13 disposed in the mounting chamber 17 at two opposite lateral sides in the middle and adapted for receiving the horizontal base wall 14, a rear wire hole 18 at the rear side in communication with the mounting chamber 17, and two springy blocks 12 respectively and diagonally raised from the top and bottom side in the mounting chamber 17 corresponding to the wire holes 7 of the insulative receptacle base A.

Figure 4:
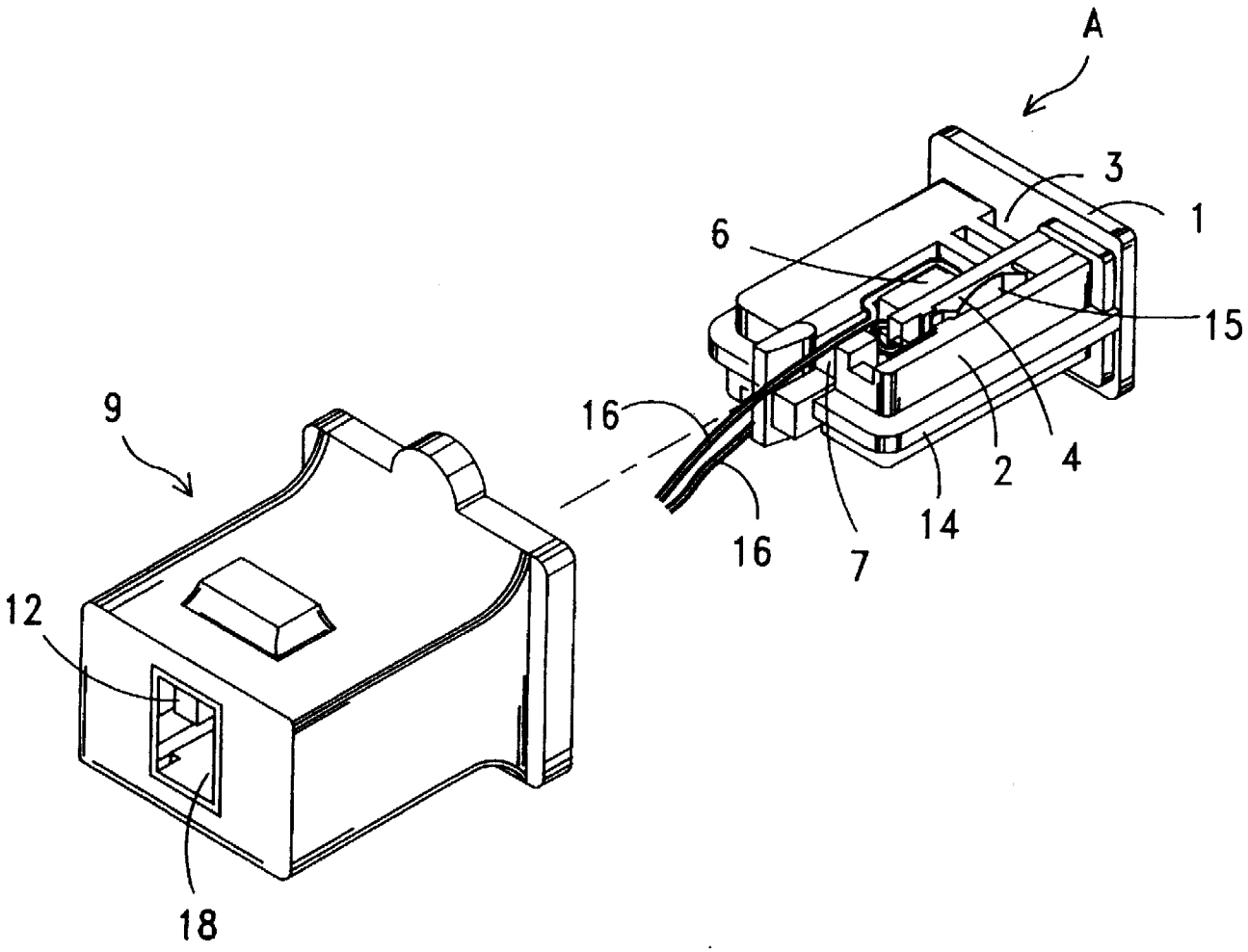
FIG. 4 is similar to FIG. 1 but showing the electric wires respectively installed in the insulative receptacle base.
Figure 5:
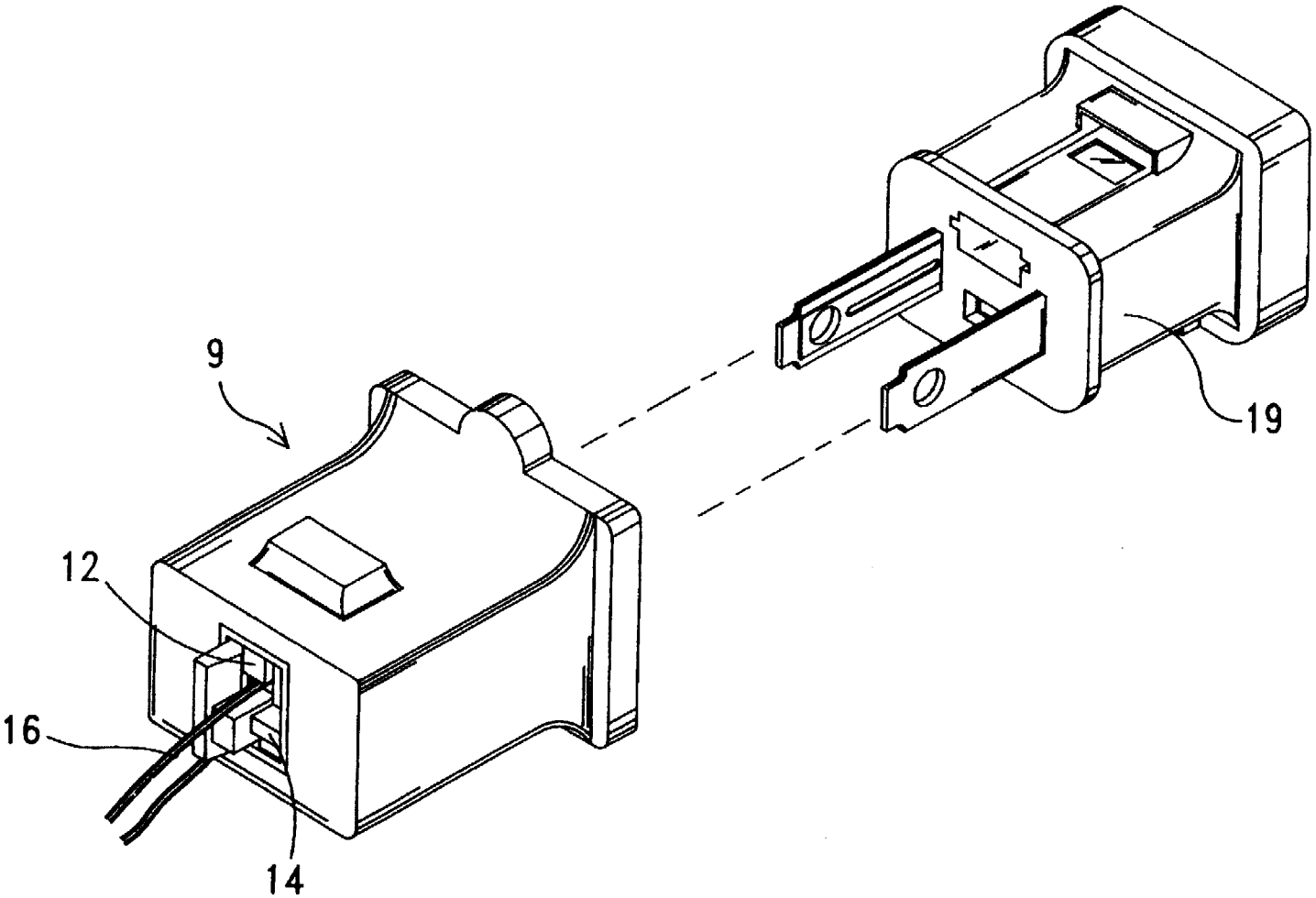
FIG. 5 is an applied view of the present invention.

Referring to FIG. 5 and FIGS. 1 and 4 again, the electric wires 16 are respectively inserted through the rear wire hole 18 of the insulative housing 9 and then through the wire holes 7 of the insulative receptacle base A into the longitudinal wire chambers 5, and then mined back over the springy blocks 6 of the insulative receptacle base A into the terminal chambers 4, permitting the terminals 15 to be respectively set in the terminal chambers 4, and then the insulative receptacle base A is fitted into the mounting chamber 17 of the insulative housing 9 by forcing the outer vertical walls 2 and the inner vertical walls 3 into engagement with the longitudinal mounting grooves 10, 11 and the horizontal base wall 14 into engagement with the longitudinal sliding grooves 13 respectively. When assembled, the springy blocks 12 are respectively pressed on the electric wires 16 to hold them down, the electric wires 16 are separated by the horizontal base wall 14 of the insulative receptacle A, and the terminals 15 of the electric wires 16 are respectively protected in the terminal chambers 4 between the outer vertical walls 2 and the inner vertical walls 3, therefore the terminals 15 are prohibited from contacting each other to cause a short circuit. Further, because the terminals 15 of the electric wires 16 are respectively disposed in the terminal chambers 4 within the vertical outer walls 2 and vertical inner walls 3, a siphon action will be produced in the longitudinal mounting grooves 10, 11 to such in permeated water. Therefore, water is effectively prohibited from passing to the inside of the terminal chambers 4 to wet the terminals 15.

While only one embodiment of the present invention has been shown and described, it will be understood that various modifications and changes could be made thereunto without departing from the spirit and scope of the invention disclosed.

What the invention claimed is:

1. An electrical receptacle comprising an insulative receptacle base having a vertical face panel and two blade insertion slots disposed in the vertical face panel and adapted for receiving blades of an electric plug, an insulative housing mounted around said insulative receptacle base and having a rear wire hole, a hot wire and a neutral wire respectively inserted through said rear wire hole of said insulative housing and having a respective terminal mounted in said insulative receptacle base for contact with the blades of the inserted electric plug respectively, wherein:

said insulative receptacle base comprises a horizontal base wall perpendicularly extended from said vertical face panel at a back side, two outer vertical walls perpendicularly extended from the back side of said vertical face panel and perpendicularly and diagonally raised from two opposite sides of said horizontal base wall, two inner vertical walls perpendicularly extended from the back side of said vertical face panel and perpendicularly and diagonally raised from two opposite sides of said horizontal base wall and respectively disposed in parallel to said outer vertical walls at an inner side, two elongated terminal chambers respectively defined between said outer vertical walls and said inner vertical walls in alignment with said blade insertion slots and adapted for holding the terminals of said hot wire and said neutral wire, two longitudinal wire chambers respectively defined at two opposite sides of said horizontal base wall and disposed at one side of said inner vertical walls opposite to said elongated terminal chambers, two springy blocks perpendicularly raised from two opposite sides of said horizontal base wall and respectively disposed in said longitudinal wire chambers and adapted for holding said hot wire and said neutral wire in place, and two wire holes respectively disposed in communication with said longitudinal wire chambers at one end through which said hot wire and said neutral wire pass out of said insulative receptacle base;

said insulative housing comprises a mounting chamber which receives said insulative receptacle base, two symmetrical pairs of longitudinal mounting grooves diagonally disposed in said mounting chamber at top and bottom sides which receive the outer vertical walls and inner vertical walls of said insulative receptacle base respectively, two horizontally spaced longitudinal sliding grooves disposed in said mounting chamber at two opposite lateral sides in the middle which receive the horizontal base wall of said insulative receptacle base, and two springy blocks respectively and diagonally raised from said top and said bottom sides in said mounting chamber corresponding to the wire holes of said insulative receptacle base and adapted for pressing on said hot wire and said neutral wire to hold them down in the longitudinal wire chambers of said insulative receptacle base.

* * * * *